United States Patent [19]

Schofield

[11] 4,133,167

[45] Jan. 9, 1979

[54] CABLE MAKING MACHINES

[75] Inventor: Richard W. Schofield, Hawkshaw, near Bury, England

[73] Assignee: The General Engineering Co. (Radcliffe) Limited, Radcliffe, England

[21] Appl. No.: 805,115

[22] Filed: Jun. 9, 1977

[30] Foreign Application Priority Data

Jun. 10, 1976 [GB] United Kingdom ..... 24003/76

[51] Int. Cl.[2] ..... D01H 7/86; D01H 1/28

[52] U.S. Cl. ..... 57/12; 57/58.65; 57/58.83

[58] Field of Search ..... 57/11, 12, 14, 58.49, 57/58.54, 58.65, 58.7, 58.83, 58.84

[56] References Cited

U.S. PATENT DOCUMENTS

| | | | |
|---|---|---|---|
| 2,189,314 | 2/1940 | Johnson | 57/12 X |
| 2,570,929 | 10/1951 | Fitch et al. | 57/11 X |
| 3,828,538 | 8/1974 | Yoshida et al. | 57/58.54 |

*Primary Examiner*—Charles Gorenstein

*Attorney, Agent, or Firm*—Fleit & Jacobson

[57] ABSTRACT

This invention concerns cable making machines and relates to a machine incorporating both twisting and cabling mechanisms. The apparatus is designed to enable the lapping section of the machine to be isolated from the twisting section in order that the machine can be used selectively for both twisting and lapping or twisting only. Common drive means is provided for the machine such drive means including, for example, a clutch for isolating the drive to the lapping section of the machine when required.

7 Claims, 8 Drawing Figures

CABLE MAKING MACHINES

Figure 1A:
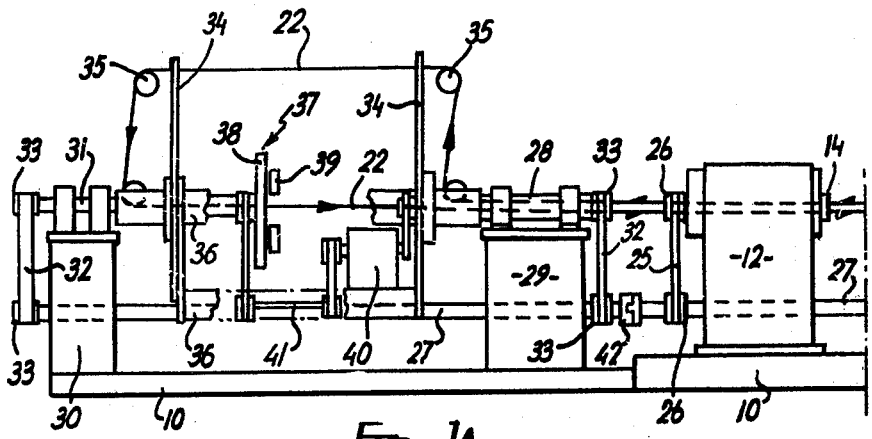

This invention concerns cable making machines and in particular in machines for twisting and lapping.

It is a common requirement for two or more elongate elements such as wires to be twisted together to form a cable. It is also sometimes necessary to lap (that is spirally wrap) a cable and normally these two operations are carried out using a single machine.

It is known that twisting alone can be carried out at relatively high speed in a double twist machine, the maximum speed of operation being generally limited by the size of the guide, or bow, which carries the wire around a rocking cradle upon which is located at least a traversing mechanism, capstan, and take-up reel for the twisted cable. It is also known however to provide a machine which has at least one lapping mechanism on the cradle in addition to the mechanisms just referred to. A machine of this kind must therefore have a cradle which is appreciably larger than that used in a comparable machine not equipped for lapping and the result is that the bow must also be larger and as stated above bow size, for twisting only, imposes speed limitations.

For twisting and lapping it is the lapping mechanism which imposes the speed limitation and normally a combined twisting and lapping operation will only be capable of being carried out at 5% to 10% of the speed of a twisting operation alone, thus the size of bow does not have an appreciable effect on operating speed. However, since more unlapped cable is produced than lapped cable, and since it is usual to operate a twisting and lapping machine when twisting only is required, the bow size imposes an appreciable speed restriction and thus the machine, which for the greatest part of its operating time will be twisting only, is being run at about two thirds of its optimum speed. This is clearly a disadvantage of a machine having both a twisting and lapping facility. A further disadvantage of the combined twisting and lapping machine lies in the fact that the quality of lapping can only be checked when the machine is stationary and thus if a fault develops in the lapping operation it may be some considerable time before it is found and rectified.

It is the primary object of the present invention to provide a machine which has both a twisting and lapping facility and which does not suffer from the disadvantages briefly set out above.

Thus according to the present invention there is provided a twisting and lapping machine for filamentary material, there being a first cradle means, adapted to carry at least a take-up device for the filamentary material, and around which is rotatable a twister bow, and a second cradle spaced from the first cradle and substantially in axial alignment therewith, said second cradle carrying at least one lapping means and around which is rotatable a filamentary material guide means, there being filamentary material diverter means between the first and second cradles adapted selectively to guide the filamentary material either directly to the take-up or to the lapping means and then the take-up.

Figure 1B:
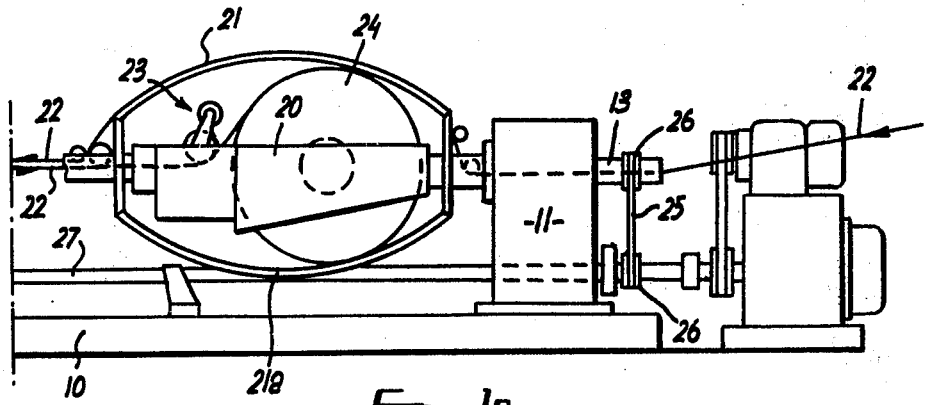
Figure 2A:
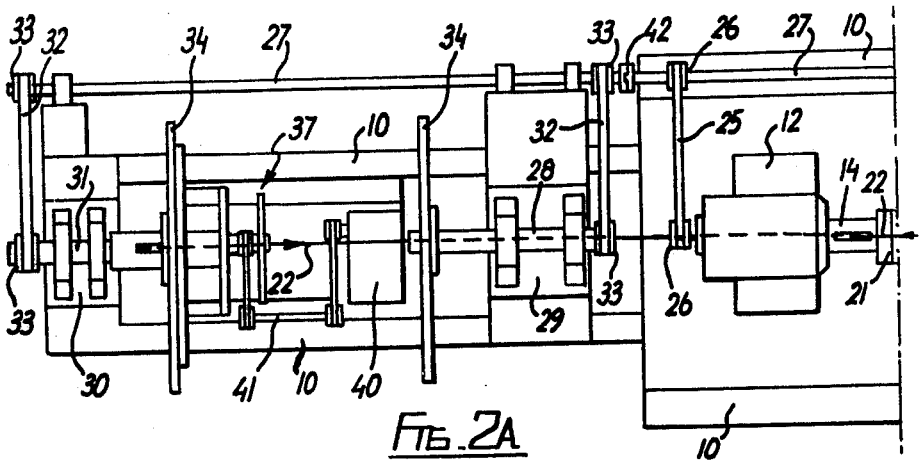
Figure 2B:
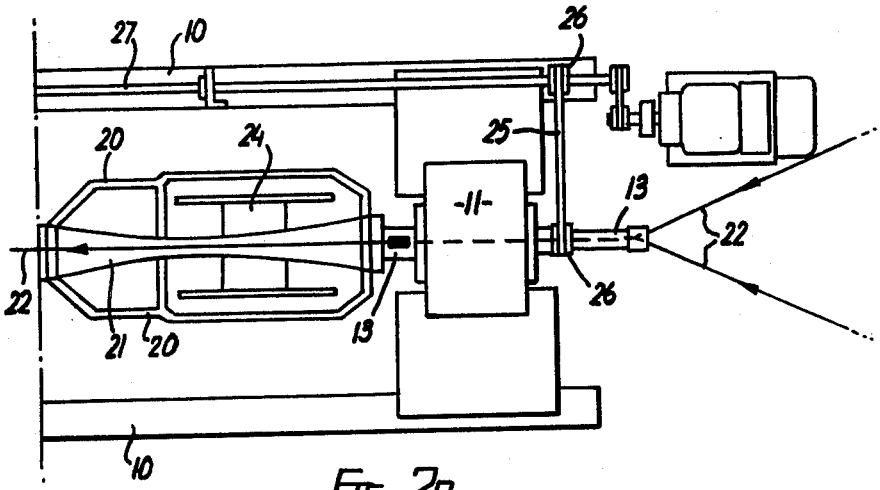

The invention will now be described further, by way of example only, with reference to one practical form thereof and the accompanying drawings in which:

FIGS. 1A and 1B comprise a diagrammatic side elevation of a twisting and lapping machine;

FIGS. 2A and 2B comprise a plan view of the machine of FIGS. 1A and 1B.

Figure 3A:
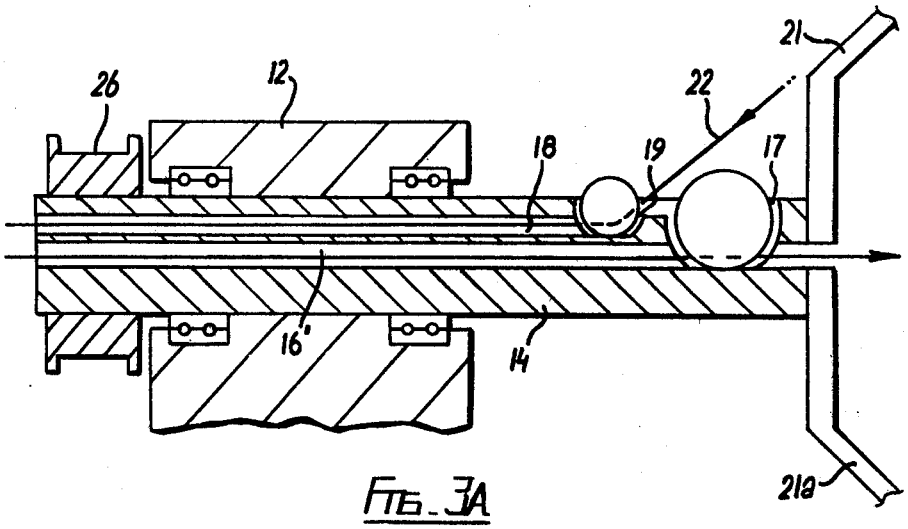
Figure 3B:
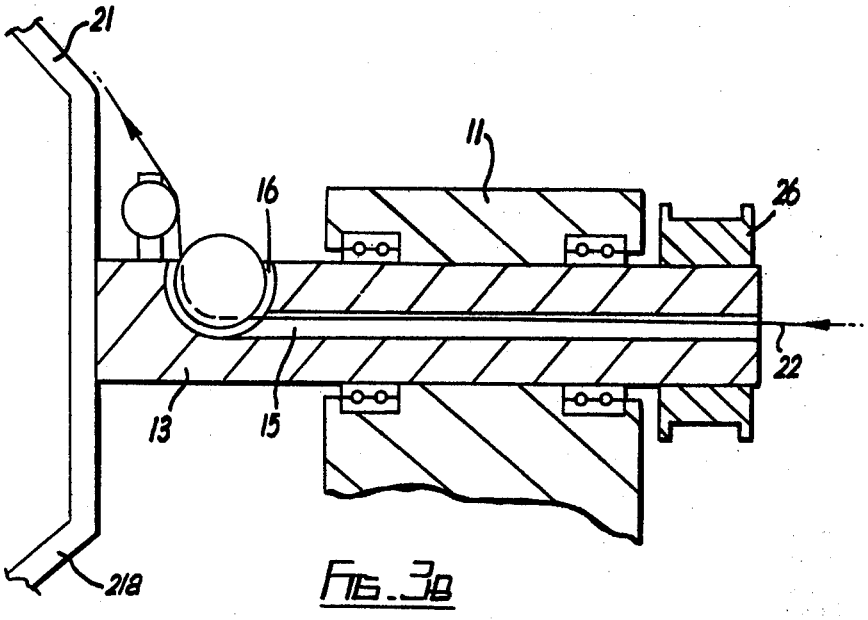
Figure 4A:
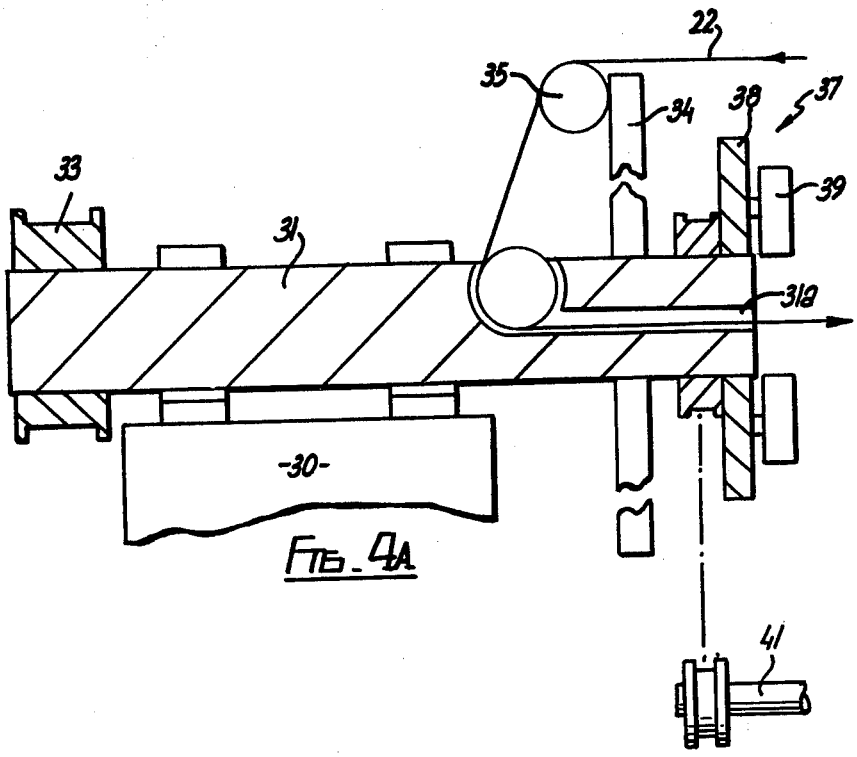
Figure 4B:
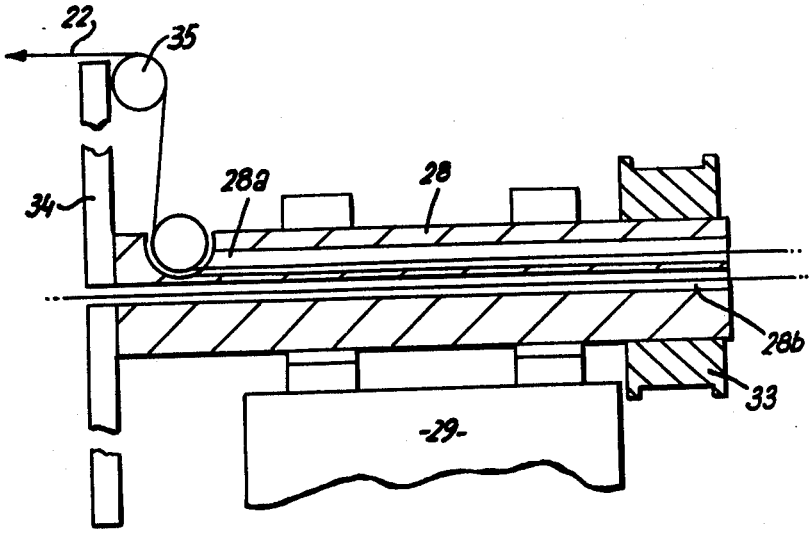

FIGS. 3A and 3B are diagrammatic part sectional views of parts of a twisting head of the machine drawn to a larger scale, and FIGS. 4A and 4B are diagrammatic part-sectional views of a lapping head of the machine drawn to a larger scale.

A combined twisting and lapping machine made in accordance with this invention includes a framework comprising a base 10 and a first pair of spaced-apart vertical supports 11, 12. Each support 11, 12 carries a shaft 13, 14 respectively rotatable in bearings. One of the shafts namely shaft 13, herein called an 'entry shaft' is provided with an axial bore 15 (see FIG. 3. in particular) extending over part of its length and communicating with a generally radially disposed bore 16. The other shaft 14 (see FIG. 3 in particular) which is in axial alignment with the enyry shaft 13 is provided with an axial bore 16' extending from end to end and a radial bore 17 joins the axial bore 16' adjacent that end of the shaft 14 nearest the entry shaft 13. This shaft 14 is also provided with a second, additional, bore 18 extending parallel to the axial bore 16' over part of the length of the shaft 14 from the end remote from the entry shaft 13 and a radial bore 19 meets the second bore 18 at its end nearest the entry shaft 13.

Mounted on the shaft 13, 14 between the supports 11, 12 is a rocking cradle 20. The cradle 20 is provided with bores through which the ends of the shafts pass and bearings are provided between the cradle and the shafts. Extending across the cradle and secured to the shafts 13, 14 is a bow 21 which serves, as is known, to guide the filaments 22 that are to be twisted into a cable. The bow 21 rotates with the shafts 13, 14 upon which it is mounted when the apparatus is in use. Mounted on the rocking cradle 20 in known manner is a capstan 23 and a take-up reel 24, drive for the take-up reel 24 being derived from the capstan 23. Drive for the shaft 13, 14 carrying the bow 21 is conveniently by means of belts 25 and pulleys 26, there being a pulley 26 on each shaft 13, 14 connected via the belts 25 to corresponding pulleys 26 on a main drive shaft 27, thus the shafts 13, 14 are driven in synchronism.

Axially aligned with the second shaft 14 referred to above is a simialr shaft 28 mounted for rotation on one of a second pair of spaced supports 29, 30 between which is located a lapping head or heads referred to below. The second (30) of the spaced supports 29, 30 carries a rotatable shaft 31 which is axially aligned with shaft 28. Drive for these two shafts 28, 31 is derived via belts 32 and pulleys 33 from the main drive shaft 27. Mounted on the shafts 28, 31 for rotation therewith are supports 34 for cable guide pulleys 35 and mounted in beaings on the shafts 28, 31 and between the spaced supports 29, 30 is a second cradle 36 which carries a lapping head 37 (or heads). For the sake of convenience, an arrangement having only one lapping head will be described. The lapping head consists of a disc 38 mounted for rotation in the cradle 36. The disc 38 has an axial bore through which a twisted cable can pass as it leaves the shaft 31. Mounted on the disc 38 is a reel 39 of material used for lapping the cable. The disc 38 is conveniently driven via gearing 40 and drive shaft 41 from one of the shafts 28, 31 (in the illustrated arrangement drive is from shaft 28) upon which the rocking cradle 36 is mounted. A reversible drive unit (not shown) is provided to enable the lapping head to be rotated in either direction so that clockwise or counterclockwise lapping can be carried out. Conveniently the whole of the lapping mechanism, including the supports 29, 30 is spaced from the twisting mechanism described above. Means, conveniently in the form of a clutch 42 in the main shaft 27, are provided to enable the drive for the lapping mechanism to be disengaged when desired.

In use, assuming that it is required to produce a lapped cable from a plurality of strands of wire 22, the latter are fed through the axial bore 15 of the inlet shaft 13 of the twisting mechanism and through guide elements (not shown) located at spaced intervals around the bow 21. It will be appreciated that as in the known mechanisms there is a compensating bow 21*a* diametrically opposite to that which carries the wire 22 to be twisted. The wires 22 leaving the bow 21 are fed through the second (non-axial) bore 18 of the shaft 14 and into a corresponding second bore 28*a* in the shaft 28 (see FIG. 4 in particular) of the lapping mechanism and from this bore 28*a* around the guide pulleys 35 to an axial bore 31*a* (see FIG. 4 in particular) of the shaft 31 of the lapping mechanism to pass through the central aperture of the disc 38 of the lapping head and thus through the axial bores 28*b* and 18 of the spaced shafts 28 and 14 to the capstan 23 and thus the take-up reel 24 of the first rocking cradle 20.

It will be appreciated that during the passage of the wires 22 from the aperture of the inlet shaft 13 of the twisting mechanism to the capstan 23 of the twisting mechanism a double twist is put into the wires 22 for each revolution of the bow 21 around the axis of the shaft 13, 14. As the twisted wires 22 pass through the central apertures of the disc 38 of the lapping head, lapping material is wrapped helically around the twisted wires 22 due to the rotation of the disc 38 and the unwinding of the material from the reel 39 mounted on the disc 38. The lapped, twisted, cable now passes through the central aperture of the shaft 14 of the twisting mechanism to the capstan 23 and the take-up reel 24.

Since there is a space between the adjacent shafts 14 and 28 of the twisting mechanism and the lapping mechanism, the lapped cable can be inspected whilst the apparatus is in operation. It is therefore possible quickly to rectify any fault in the lapping of the cable since continuous inspection can be carried out if desired.

Assuming now that it is only necessary to provide a twisted cable, drive to the lapping mechanism is disconnected by disengaging clutch 42 and the wires 22 are led from the bow 21 of the twisting mechanism directly into the shaft 14 and from there to the capstan 23 and take-up reel 24.

The advantage of the apparatus described above lies in the fact that when the lapping mechanism drive is disconnected, the speed of the bow 21 of the twisting mechanism can be increased, from that at which it would rotate when twisting and lapping are taking place, to its optimum speed for twisting. It follows that when the apparatus is being used for lapping and twisting, the optimum speed for lapping will be employed and thus the machine, whichever function is being carried out, can be run to produce maximum output for that particular operation.

I claim:

1. A twisting and lapping machine for filamentary material, there being a first cradle means for carrying at least a take-up device for the filamentary material, and around which is rotatable a twister bow, and a second cradle means spaced from the first cradle means and substantially in axial alignment therewith for carrying at least one means for lapping and around which is rotatable a filamentary material, common drive means for driving the twister bow and means for lapping, means for disconnecting the drive to the means for lapping when required, guide means for guiding the filamentary material, and there being filamentary material diverter means between the first and second cradle means for guiding the filamentary material either directly to the take-up device or to the means for lapping and then the take-up device.

2. A twisting and lapping machine for filamentary material, there being a first cradle means carrying at least a take-up devicd for the filamentary material, and around which is rotatable a twister bow, and a second cradle means spaced from the first cradle means and substantially in axial alignment therewith, said second cradle means carrying at least one lapping means and around which is rotatable a filamentary material guide means, there being filamentary material diverter means between the first and second cradle means for guiding the filamentary material either directly to the take-up device or to the lapping means and then the take-up device, and drive means for driving said lapping means, said drive means including means for disconnecting the drive means from said lapping means when required.

3. A machine as claimed in claim 2 in which the take-up device comprises a capstan and a take-up reel adapted to be driven by the capstan.

4. A machine as claimed in claim 2 in which the lapping means includes a carrier disc for a lapping material supply reel, said disc being adapted to be driven via drive means on the second cradle means.

5. A machine as claimed in claim 2 in which the rotatable filamentary guide means of the second cradle means includes rotatable shafts through which twisted filamentary material to be lapped can pass and support means mounted on the rotatable shafts for carrying cable guide pulleys.

6. A machine as claimed in claim 2 in which the filamentary material diverter means is in the form of a guide element arranged adjacent a cradle shaft of said first cradle means and so disposed as to lead twisted filamentary material directly from the twister bow to a bore in the same shaft and thus to the take-up device.

7. A twisting and lapping machine for filamentary material, there being a first cradle means carrying at least a take-up device for the filamentary material, and around which is rotatable a twister bow, and a second cradle means spaced from the first cradle means, said second cradle means carrying at least a lapping means and around which is rotatable a filamentary material guide means, there being filamentary material diverter means between the first and second cradle means for guiding the filamentary material either directly to the take-up device or to the lapping means and then the take-up device, and drive means for driving said lapping means, said drive means including means for disconnecting the drive means from said lapping means when required.

* * * * *